United States Patent [19]

Hertrich et al.

[11] Patent Number: 4,800,851

[45] Date of Patent: Jan. 31, 1989

[54] HYDRAULIC PLAY COMPENSATING ELEMENT

[75] Inventors: Steffen Hertrich, Herzogenaurach; Friedrich Ness, Dachsbach, both of Fed. Rep. of Germany; Charles Knorr, Niederbronn, France

[73] Assignee: INA Walzlager Schaeffler KG, Fed. Rep. of Germany

[21] Appl. No.: 152,540

[22] Filed: Feb. 5, 1988

[30] Foreign Application Priority Data

Feb. 25, 1987 [DE] Fed. Rep. of Germany ..... 3706006

[51] Int. Cl.[4] ..... F01L 1/24

[52] U.S. Cl. ..... 123/90.46; 123/90.55

[58] Field of Search ..... 123/90.43, 90.46, 90.55, 123/90.56, 90.57, 90.58, 90.59, 90.63

[56] References Cited

U.S. PATENT DOCUMENTS

| | | | |
|---|---|---|---|
| 4,570,582 | 2/1986 | Speil | 123/90.46 |
| 4,708,103 | 11/1987 | Spiel | 123/90.46 |
| 4,716,865 | 1/1988 | Schaeffler | 123/90.46 |
| 4,716,867 | 1/1988 | Speil | 123/90.46 |
| 4,729,350 | 3/1988 | Speil | 123/90.46 |

FOREIGN PATENT DOCUMENTS

| | | | |
|---|---|---|---|
| 3526292 | 3/1986 | Fed. Rep. of Germany | 123/90.46 |

*Primary Examiner*—Willis R. Wolfe

*Attorney, Agent, or Firm*—Bierman and Muserlian

[57] ABSTRACT

A hydraulic play compensating element (1) for a valve control mechanism in internal combustion engines comprising an outer piston (4) closed on one end and insertable for displacement in the longitudinal direction in a bore (2) of a structural element (3) of the valve drive and which guides an inner piston (5) for longitudinal displacement with slight play in a longitudinal bore wherein both pistons encompass a high pressure chamber (6) therebetween which communicates via a check valve (7) arranged in the inner piston with an oil reservoir (8) provided in the inner piston (5), and wherein the inner piston (5) is supported at its end facing away from the pressure chamber by a disc (9) which is fixed in the bore (2) of the structural element (3) of the valve drive, characterized in that the disc (9) engages the bore (16) of the inner piston (5) with radially resilient clamping projections (15) upon contacting the end of the inner piston (5) facing away from the pressure chamber (16).

15 Claims, 6 Drawing Sheets

HYDRAULIC PLAY COMPENSATING ELEMENT

STATE OF THE ART

Figure 1:
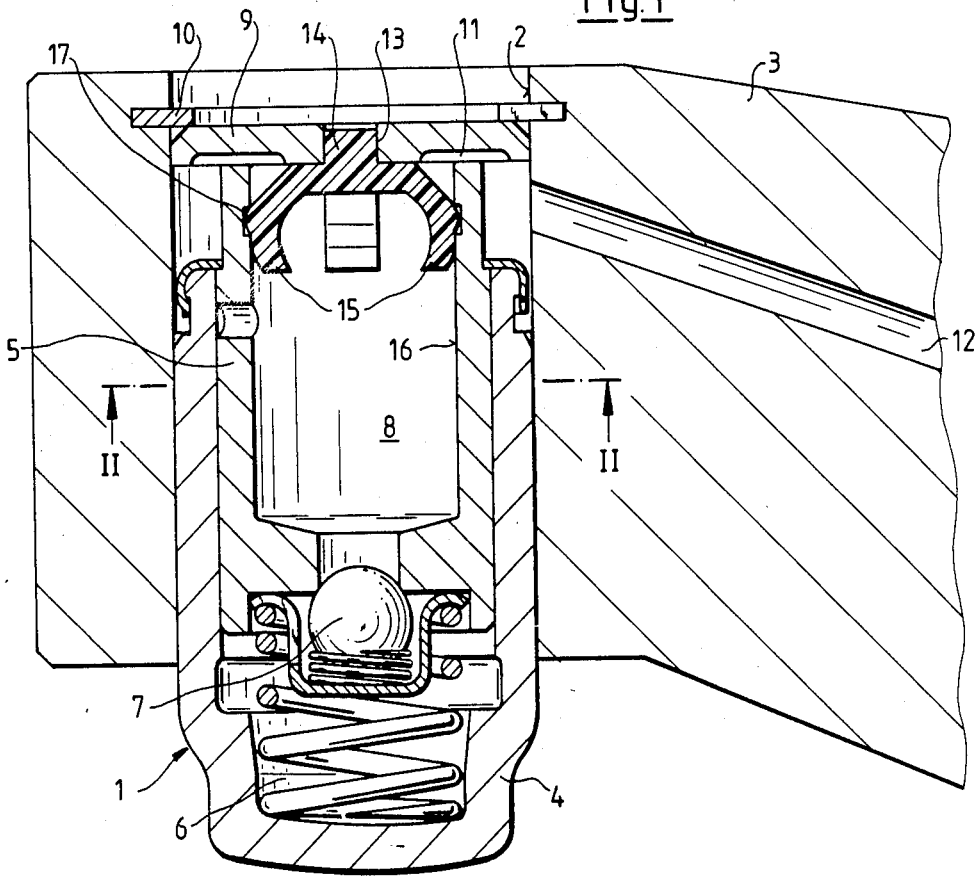

Hydraulic play compensating elements (1) for a valve control mechanism in internal combustion engines comprising an outer piston (4) closed on one end and insertable for displacement in the longitudinal direction in a bore (2) of a structural element (3) of the valve drive and which guides an inner piston (5) for longitudinal displacement with slight play in a longitudinal bore wherein both pistons encompass a high pressure chamber (6) therebetween which communicates via a check valve (7) arranged in the inner piston with an oil reservoir (8) provided in the inner piston (5), and wherein the inner piston (5) is supported at its end facing away from the pressure chamber by a disc (9) which is fixed in the bore (2) of the structural element (3) of the valve drive are known. Such play compensating elements are, for example, arranged in bores of rocker arms. For manufacturing reasons, the bore in the rocker arms is designed as a continuous bore accommodating a disc supported e.g. by a retaining ring and itself supports the hydraulic play compensating element. The disc is provided on its surface cooperating with the play compensating element with indentations which allows transfer of oil from outside into the interior of the inner piston.

These known play compensating elements experienced some problems upon installation in a rocker arm because the disc must first be inserted in the bore before introducing the hydraulic play compensating element. Therefore, it could happen that the disc after being inserted in the bore may fall out therefrom again. Furthermore, it could also occur that upon insertion of the disc, the latter was turned by 180 degrees so that its indentations did not bear against the play compensating element but instead by a flat surface which prevents the oil transfer. Finally, it is also conceivable that the insertion of the disc in the bore could be forgotten altogether. Thus, all these problems could be encountered which as experience shows occur during assembly of several separate parts wherein those parts in addition have to be assembled in a positional dependence.

OBJECTS OF THE INVENTION

It is an object of the invention to provide in the simplest technical manner an assembly unit which includes the hydraulic compensating element, on the one hand, and the disc, on the other hand, to prevent errors during assembly.

This and other objects and advantages of the invention will become obvious from the following detailed description.

THE INVENTION

The novel hydraulic play compensating element of the invention for a valve control mechanism in internal combustion engines comprising an outer piston (4) closed on one end and insertable for displacement in the longitudinal direction in a bore (2) of a structural element (3) of the valve drive and which guides an inner piston (5) for longitudinal displacement with slight play in a longitudinal bore wherein both pistons encompass a high pressure chamber (6) therebetween which communicates via a check valve (7) arranged in the inner piston with an oil reservoir (8) provided in the inner piston (5), and wherein the inner piston (5) is supported at its end facing away from the pressure chamber by a disc (9) which is fixed in the bore (2) of the structural element (3) of the valve drive, is characterized in that the disc (9) engages the bore (16) of the inner piston (5) with radially resilient clamping projections (15) upon contacting the end of the inner piston (5) facing away from the pressure chamber (6).

In this manner, a force-locking connection is attained between the hydraulic play compensating element and the disc. If it is desired to attain a more improved connection between the play compensating element and the disc, the bore of the inner piston may have a circumferential groove engaged by the clamping projections to produce a form-fitting connection.

Referring now to the drawings

Figure 2:
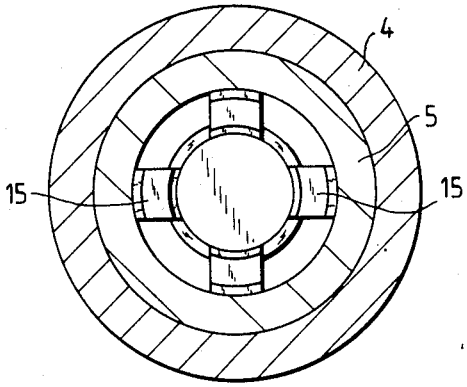

FIG. 1 is a longitudinal cross-section through a hydraulic play compensating element of the invention, FIG. 2 is a cross-section taken along the line II—II of FIG. 1 and FIGS. 3 to 12 are respective longitudinal cross-sections and cross-sections through further embodiments of the invention.

FIGS. 1 and 2 illustrate an embodiment in which a hydraulic play compensating element 1 is supported in a bore 2 of a rocker arm and the hydraulic play compensating element 1 includes an outer piston 4 which is closed on its one end and guides in a longitudinal bore the inner piston for longitudinal displacement at slight play. Both pistons 4 and 5 encompass a high pressure chamber 6 therebetween which is connected by a check valve 7 arranged in the inner piston 5 with an oil reservoir 8 provided in the inner piston 5. The hydraulic play compensating element bears with its end facing away from the high pressure chamber 6 against a disc 9 which is inserted in the bore 2 and is supported therein by a retaining ring 10. The disc 9 is provided at its surface facing the hydraulic compensating element 1 with molded indentations 11 which allow the passage of oil into the oil reservoir 8. The oil supply to the hydraulic play compensating element 1 is obtained via the oil bore 12 in the rocker arm 3.

The disc 9 is provided with a central bore 13 in which the central pin 14 of a plastic element is inserted which element has clamping projections 15 engaging under radial prestress in the bore 16 of the inner piston and thereby fixes the disc 9 to the hydraulic play compensating element 1. The connection of the disc 9 may be improved by engaging the clamping projections 15 in a circumferential groove 17 of the bore 16. In this case, the clamping projections 15 are designed as several circumferentially spaced spring tongues curved radially outwardly.

Figure 3:
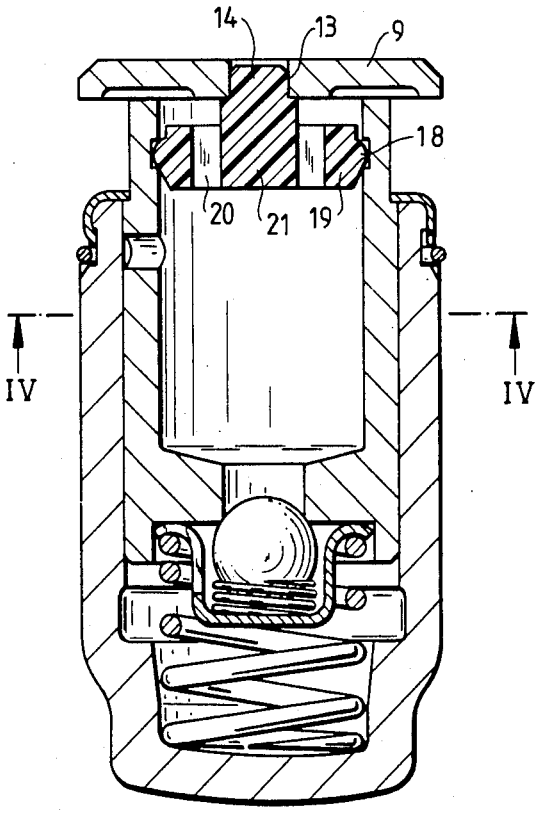
Figure 4:
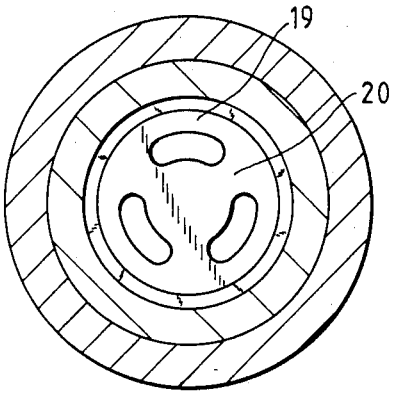
Figure 5:
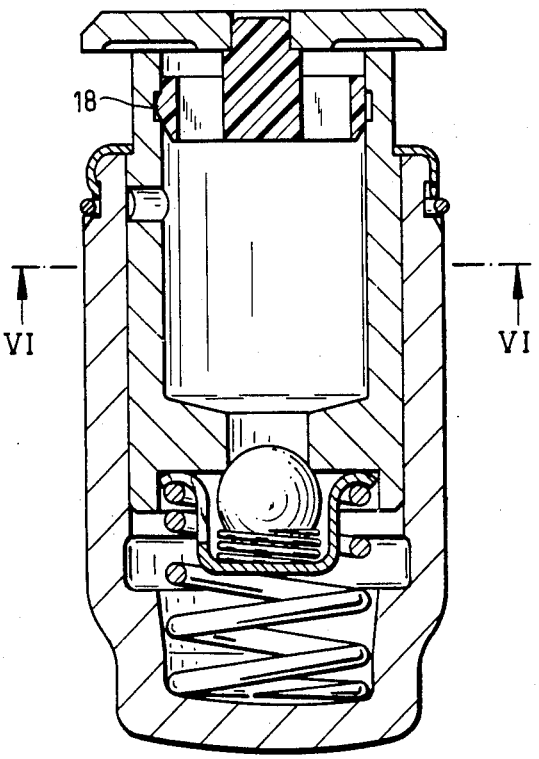
Figure 6:
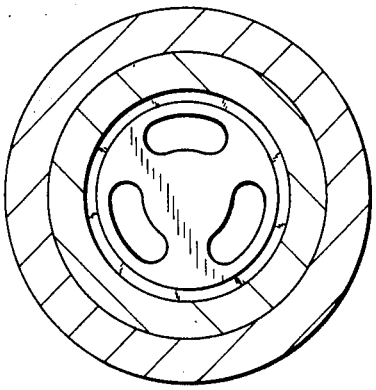

In the embodiment illustrated in FIGS. 3 and 4, the clamping projection is defined by an enlargement 18 which radially exceeds outwardly a circumferential ring 19 connected through several spoken 20 with a central hub 21 which supports the central pin 14 inserted in the central bore 13 of the disc 9. The embodiment as illustrated in FIGS. 5 and 6 differs from the preceding one essentially in that the enlargement 18 extends only over a part of the circumferential areas between two succeeding spokes.

Figure 7:
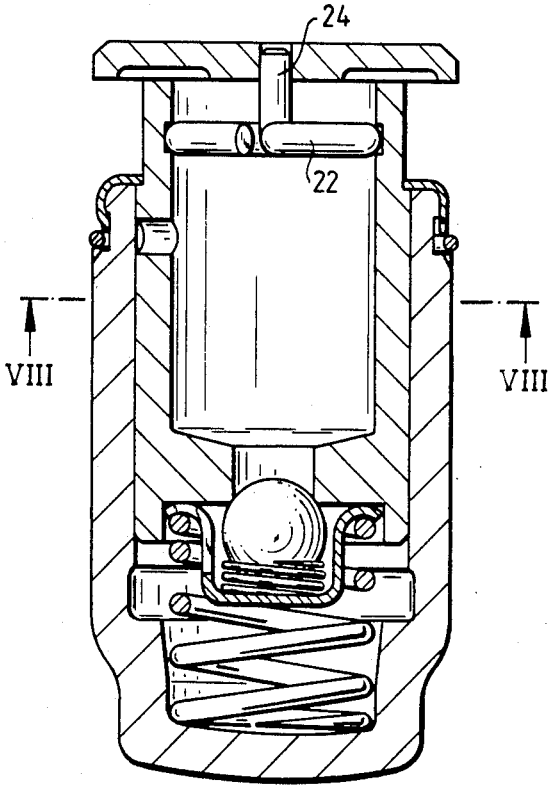
Figure 8:
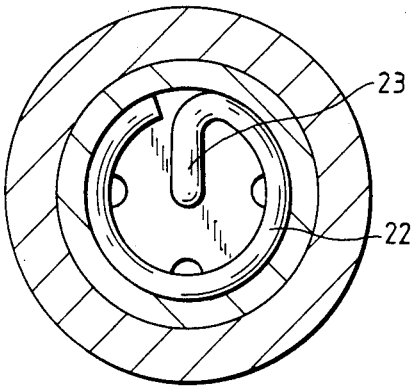

While the embodiments described so far were designed as plastic elements, the following modifications are concerned with metal parts. FIGS. 7 and 8 show an embodiment in which one clamping projection is defined by a wire ring 22 open at one circumferential area and connected at its one open end with a radially inwardly directed spoke 23 to which the axially extending central pin 24 is connected.

Figure 9:
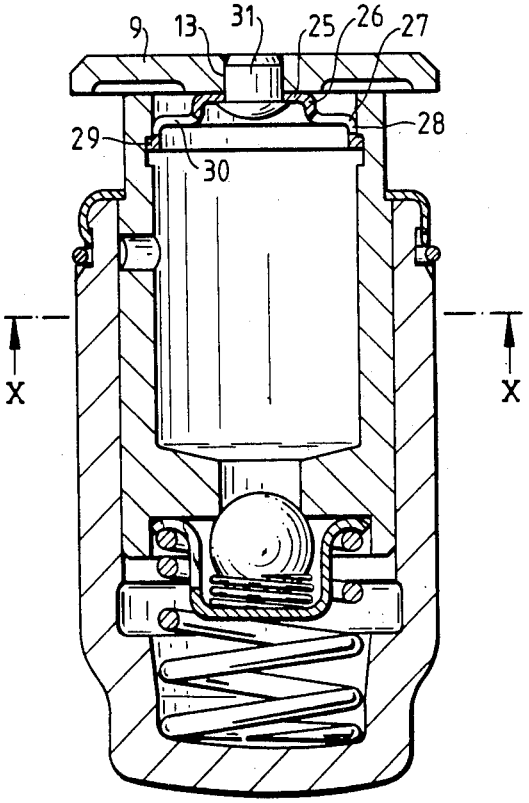
Figure 10:
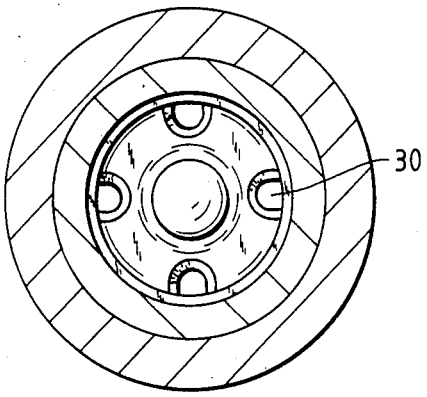
Figure 11:
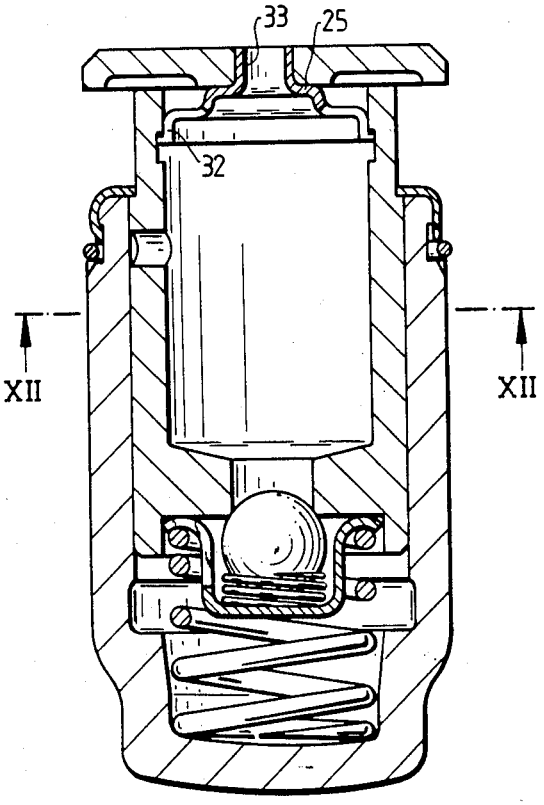
Figure 12:
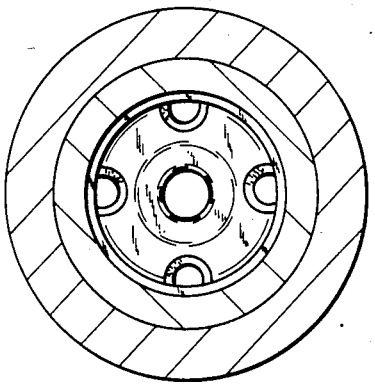

In the embodiment of FIGS. 9 and 10, the additional structural element is designed as a enlement drawn from sheet metal which extends from a central plate 25 with a diameter enlarged by two successive steps 26 and 27 and ending in a circumferential ring 28 with a projecting collar 29. To allow the oil passage and to simulataneously improve the resiliency, the sheet metal element is provided with breakthroughs at several circumferential areas in the region between the central plate 25 and the circumferential ring 28. In this case, the attachment of the sheet metal element to the disc 9 is accomplished by an additional rivet 1 inserted in a bore of the central plate 25 and pressed in the central bore 13 of the disc 9. The embodiment of FIGS. 11 and 12 differs from the preceding one in that the breakthroughs 32 also traverse the collar 29. Otherwise, for attachment of the sheet metal element 4, a traversing collar 33 is provided which extends directly from the central plate 25.

Various other modifications of the elements of the invention may be made without departing from the spirit or scope thereof and it is to be understood that the invention is intended to be limited only as defined in the appended claims.

What is claimed is:

1. A hydraulic play compensating element (1) for a valve control mechanism in internal combustion engines comprising an outer piston (4) closed on one end and insertable for displacement in the longitudinal direction in a bore (2) of a structural element (3) of the valve drive and which guides an inner piston (5) for longitudinal displacement with slight play in a longitudinal bore wherein both pistons encompass a high pressure chamber (6) therebetween which communicates via a check valve (7) arranged in the inner piston with an oil reservoir (8) provided in the inner piston (5), and wherein the inner piston (5) is supported at its end facing away from the pressure chamber by a disc (9) which is fixed in the bore (2) of the structural element (3) of the valve drive, characterized in that the disc (9) engages the bore (16) of the inner piston (5) with radially resilient clamping projections (15) upon contacting the end of the inner piston (5) facing away from the pressure chamber (6).

2. A play compensating element of claim 1 wherein a circumferential groove (17) is provided in the bore (16) of the inner piston (5) and engages the clamping projections (15).

3. A play compensating element of claim 1 wherein the metallic disc (9) includes a central bore (13) in which an additional structural element provided with clamping projections (15) is fixed.

4. A play compensating element of claim 3 wherein the additional structural element has a central pin (14) for insertion in the bore (13) of the disc (9) and from which the radially prestressed clamping projections (15) extends.

5. A play compensating element of claim 4 wherein the additional structural element is designed as plastic molding.

6. A play compensating element of claim 4 wherein the clamping projections (15) are designed as several circumferentially spaced spring tongues radially curved outwardly.

7. A play compensating element of claim 4 wherein one clamp projection is defined by an enlargement (18) which exceeds radially outwardly a circumferential ring (19) connected via several spokes (20) with a central hub (21) which supports the central pin (14).

8. A play compensating element of claim 7 wherein the enlargement (18) extends only over a part of the circumferential areas between two succeeding spokes (20).

9. A play compensating element of claim 8 wherein the additional structural element is made of metal.

10. A play compensating element of claim 9 wherein one clamping projection is defined by a wire ring (22) open on one circumferential area and connected at its one open end to a radially inwardly directed spoke (23) to which the axially extending central pin (24) is connected.

11. A play compensating element of claim 4 wherein the additional structural element is drawn from sheet metal and extends from a central plate (25) with a diameter enlarged in two successive steps (26,27) and ending in a circumferential ring (28) with a projecting collar (29).

12. A play compensating element of claim 11 wherein the additional structural element is provided with breakthroughs (30) at several circumferential areas in the region between the central plate (25) and the circumferential ring (28).

13. A play compensating element of claim 12 wherein the breakthroughs (32) also traverse the collar (29).

14. A play compensating element of claim 11 wherein the central plate (25) has a collar (33) integrally formed on the latter and defining the central pin.

15. A play compensating element of claim 11 wherein the central plate (25) has a bore in which a rivet (31) is inserted for defining the central pin.

* * * * *